US006388620B1

(12) United States Patent
Bhattacharyya

(10) Patent No.: US 6,388,620 B1
(45) Date of Patent: May 14, 2002

(54) SLOT-COUPLED PATCH REFLECT ARRAY ELEMENT FOR ENHANCED GAIN-BAND WIDTH PERFORMANCE

(75) Inventor: Arun Bhattacharyya, El Segundo, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/593,182

(22) Filed: Jun. 13, 2000

(51) Int. Cl.[7] ..... H01Q 1/38; H01P 1/18
(52) U.S. Cl. ..... 343/700 MS; 343/913
(58) Field of Search ..... 343/700 MS, 840, 343/781 CA, 913, 909, 778, 753, 779

(56) References Cited

U.S. PATENT DOCUMENTS 5,124,713 A * 6/1992 Mayes et al. ..... 343/700 MS
5,241,321 A * 8/1993 Tsao ..... 343/700 MS
6,081,235 A * 6/2000 Romanofsky ..... 343/700 MS

* cited by examiner

*Primary Examiner*—Don Wong
*Assistant Examiner*—James Clinger

(74) *Attorney, Agent, or Firm*—Gates & Cooper LLP

(57) ABSTRACT

An antenna element, an antenna system, and a method for producing a signal using slot-coupled antenna elements are disclosed. The antenna element comprises an electrically conductive strip, a patch element, overlaying the electrically conductive strip, and a ground plane. The ground plane is coupled between the patch element and the electrically conductive strip and comprises an opening, at least a portion of the opening overlapping with at least a portion of the electrically conductive strip, wherein the opening and the electrically conductive strip can reflect incident radio frequency (RF) energy in a desired radiation pattern. A method in accordance with the present invention comprises illuminating a reflector with an RF signal emanating from a feed horn, wherein the reflector comprises at least one reflect array antenna element, and reflecting the RF signal from the reflect array element, wherein the reflect array element comprises an electrically conductive strip, a patch element, overlaying the electrically conductive strip, and a ground plane. The ground plane is coupled between the patch element and the electrically conductive strip and comprises an opening, at least a portion of the opening overlapping with at least a portion of the electrically conductive strip, wherein the opening and the electrically conductive strip assist in generating the desired radiation pattern.

13 Claims, 9 Drawing Sheets

600

SLOT-COUPLED PATCH REFLECT ARRAY ELEMENT FOR ENHANCED GAIN-BAND WIDTH PERFORMANCE

BACKGROUND OF THE INVENTION

1. Field of the Invention.

This invention relates in general to antenna systems, and in particular to a slot coupled patch reflect array element for enhanced gain-bandwidth performance.

2. Description of Related Art.

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

Typical antenna systems use either parabolic reflectors or shaped reflectors to provide a specific beam coverage, or use a flat reflector system with an array of reflective printed patches or dipoles on the flat surface. These "reflect array" reflectors used in antennas are designed such that the reflective patches or dipoles shape the beam much like a shaped reflector or parabolic reflector would, but are much easier to manufacture and package on the spacecraft.

The conventional elements used in a typical reflect array antenna are printed dipoles or printed patches. Reflect arrays using such elements are typically design limited to have either a narrow bandwidth or a low gain. The gain and bandwidth of a reflect array antenna system is dependent upon the electrical characteristics of the elements. For a patch element (or dipole element) the phase versus length curve, typically known as the "S-curve" because the shape of the curve looks like an inverted "S," is very stiff, i.e., the slope of the curve is very steep through the phase change region. Further, the phase variation is not linear with frequency. Therefore the reflect array elements used in such an antenna system cannot maintain the desired phase distribution over a wide frequency range. The stiffness of the S-curve can be improved by using a thicker substrate for the patch or dipole elements of the reflect array. However, the thicker substrate elements have a reduced dynamic range of the phase of each element. As a result, some of the patch or dipole element phases that are beyond the available dynamic range cannot be realized by varying the physical dimensions of the patch elements. This causes a reduction in the gain of the element array antenna system, and prevents a high gain, wide band performance from a reflect array using conventional patch or dipole elements.

It can be seen, then, that there is a need in the art for reflect array elements that have a high dynamic range of the phase for each element. It can also be seen that there is a need in the art for reflect array elements that have a high gain while maintaining a high dynamic range of the phase for each element.

SUMMARY OF THE INVENTION

To overcome the limitations in the prior art described above, and to overcome other limitations that will become apparent upon reading and understanding the present specification, the present invention discloses an antenna element, an antenna system, and a method for producing a signal using slot-coupled antenna elements. The antenna element comprises an electrically conductive strip, a patch element, overlaying the electrically conductive strip, and a ground plane. The ground plane is coupled between the patch element and the electrically conductive strip and comprises an opening, at least a portion of the opening overlapping with at least a portion of the electrically conductive strip, wherein the opening and the electrically conductive strip can reflect incident radio frequency (RF) energy in a desired radiation pattern.

A method in accordance with the present invention comprises illuminating a reflector with an RF signal emanating from a feed horn, wherein the reflector comprises at least one reflect array antenna element, and reflecting the RF signal from the reflect array element, wherein the reflect array element comprises an electrically conductive strip, a patch element, overlaying the electrically conductive strip, and a ground plane. The ground plane is coupled between the patch element and the electrically conductive strip and comprises an opening, at least a portion of the opening overlapping with at least a portion of the electrically conductive strip, wherein the opening and the electrically conductive strip assist in generating the desired radiation pattern The present invention provides reflect array elements that have a high dynamic range of the phase for each element. The present invention also provides reflect array elements that have a high gain while maintaining a high dynamic range of the phase for each element.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown byway of illustration a specific embodiment in which the invention may be practiced. It is to be understood that other embodiments may be utilized and structural changes may be made without departing from the scope of the present invention.

Satellite Environment

Figure 1A:
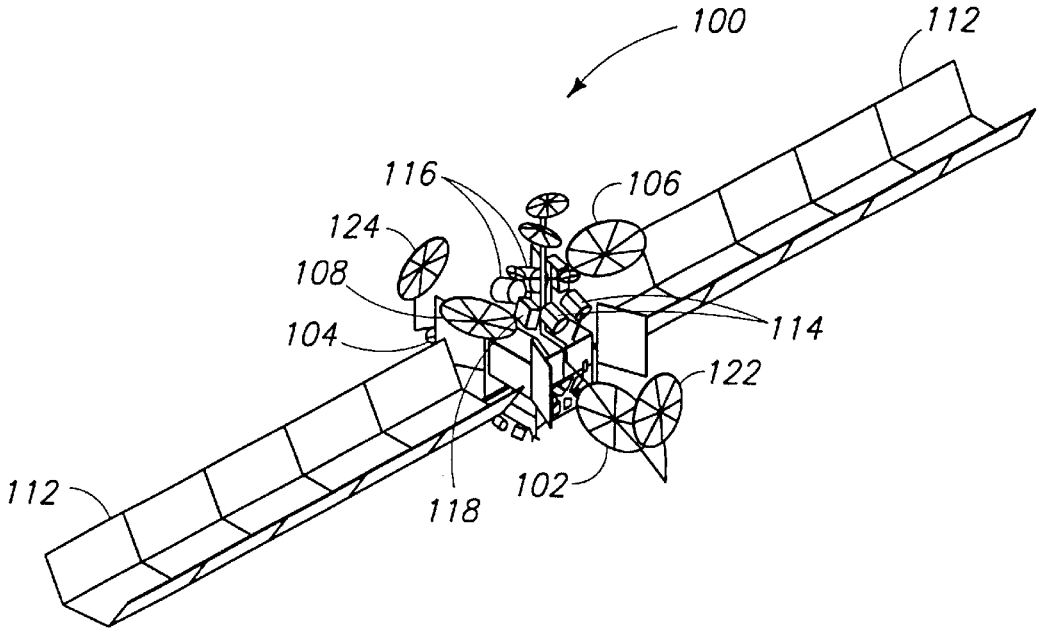
FIGS. 1A and 1B illustrate a typical satellite environment for the present invention.
Figure 1B:
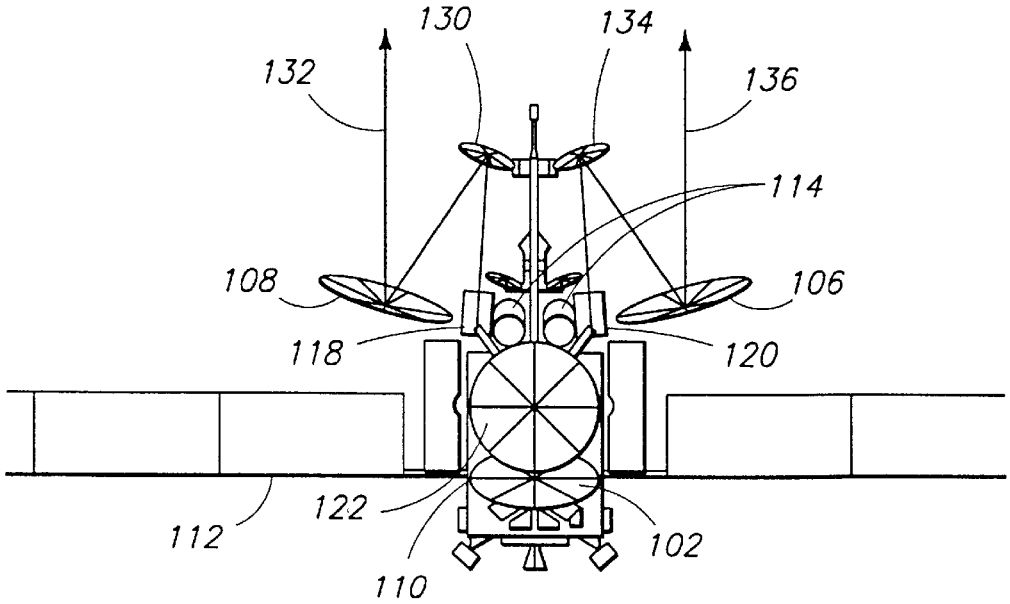

FIGS. 1A and 1B illustrate a typical satellite environment for the present invention.

Spacecraft 100 is illustrated with four antennas 102–108. Although shown as dual reflector antennas 102–108, antennas 102–108 can be direct fed single reflector antennas 102–108 without departing from the scope of the present invention. Antenna 102 is located on the east face of the spacecraft bus 110, antenna 104 is located on the west face of spacecraft bus 110, antenna 106 is located on the north part of the nadir face of the spacecraft bus 110, and antenna 108 is located on the south part of the nadir face of the spacecraft bus 110. Solar panels 112 are also shown for clarity.

Feed horns 114–120 are also shown. Feed horn 114 illuminates antenna 102, feed horn 116 illuminates antenna 104, feed horn 118 illuminates antenna 108, and feed horn 120 illuminates antenna 106. Feed horn 114 is directed towards subreflector 122, which is aligned with antenna 102. Feed horn 116 is directed towards subreflector 124, which is aligned with antenna 104. Feed horns 114–120 can be single or multiple sets of feed horns as desired by the spacecraft designer or as needed to produce the beams desired for geographic coverage. For example, feed horns 114 and 116 are shown as two banks of feed horns, but could be a single bank of feed horns, or multiple banks of feed horns, as desired. Antennas 102 and 104 are shown in a side-fed offset Cassegrain (SFOC) configuration, which are packaged on the East and West sides of the spacecraft bus 110. Antennas 106 and 108 are shown as offset Gregorian geometry antennas, but can be of other geometric design if desired. Further, antennas 102–108 can be of direct fed design, where the subreflectors are eliminated and the feed horns 114–120 directly illuminate reflectors 102–108 if desired. Further, any combination of Cassegrainian, Gregorian, SFOC, or direct illumination designs can be incorporated on spacecraft 100 without departing from the scope of the present invention.

Feed horn 118 illuminates subreflector 130 with RF energy, which is aligned with antenna 108 to produce output beam 132. Feed horn 120 illuminates subreflector 134 with RF energy, which is aligned with antenna 106 to produce beam 136. Beams 132 and 136 are used to produce coverage patterns on the Earth's surface. Beams 132 and 136 can cover the same geographic location, or different geographic locations, as desired. Further, feed horns 118 and 120 can illuminate the antennas 102–108 with more than one polarization of RF energy, i.e., left and right hand circular polarization, or horizontal and vertical polarization, simultaneously.

Although described with respect to satellite installations, the antennas described herein can be used in alternative embodiments, e.g., ground based systems, mobile based systems, etc., without departing from the scope of the present invention. Further, although the spacecraft 100 is described such that the feed horns 114–120 provide a transmitted signal from spacecraft 100 via the reflectors 102–108, the feed horns 114–120 can be diplexed such that signals can be received on the spacecraft 100 via reflectors 102–108.

Overview Of The Present Invention

The present invention is a printed element that can be used in a reflect array antenna. When the invented element is used in a reflect array antenna, the antenna shows an improved performance, in terms of gain and bandwidth, over a conventional reflect array element.

Figure 2A:
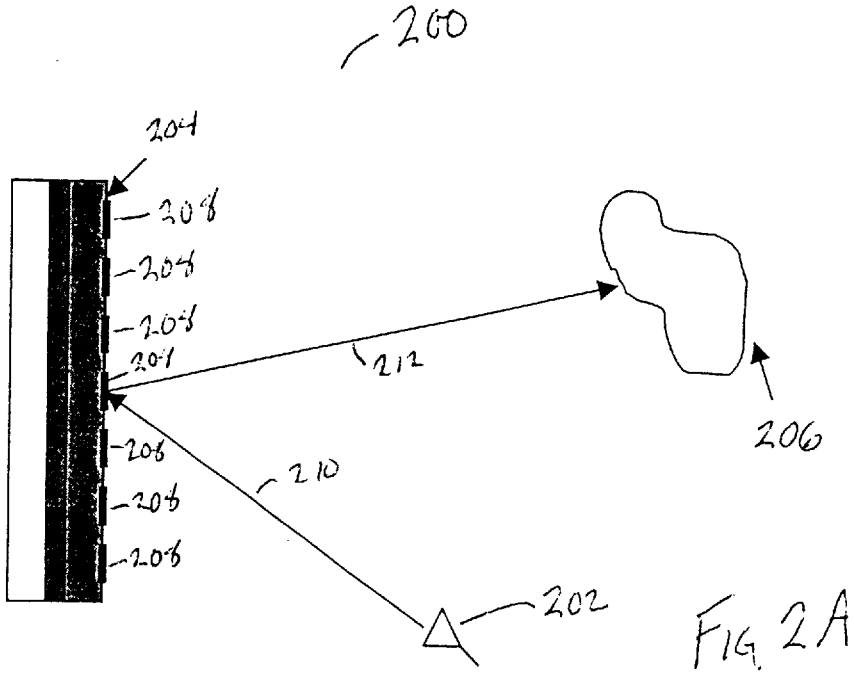
FIGS. 2A and 2B illustrate the reflect array element of the present invention.
Figure 2B:
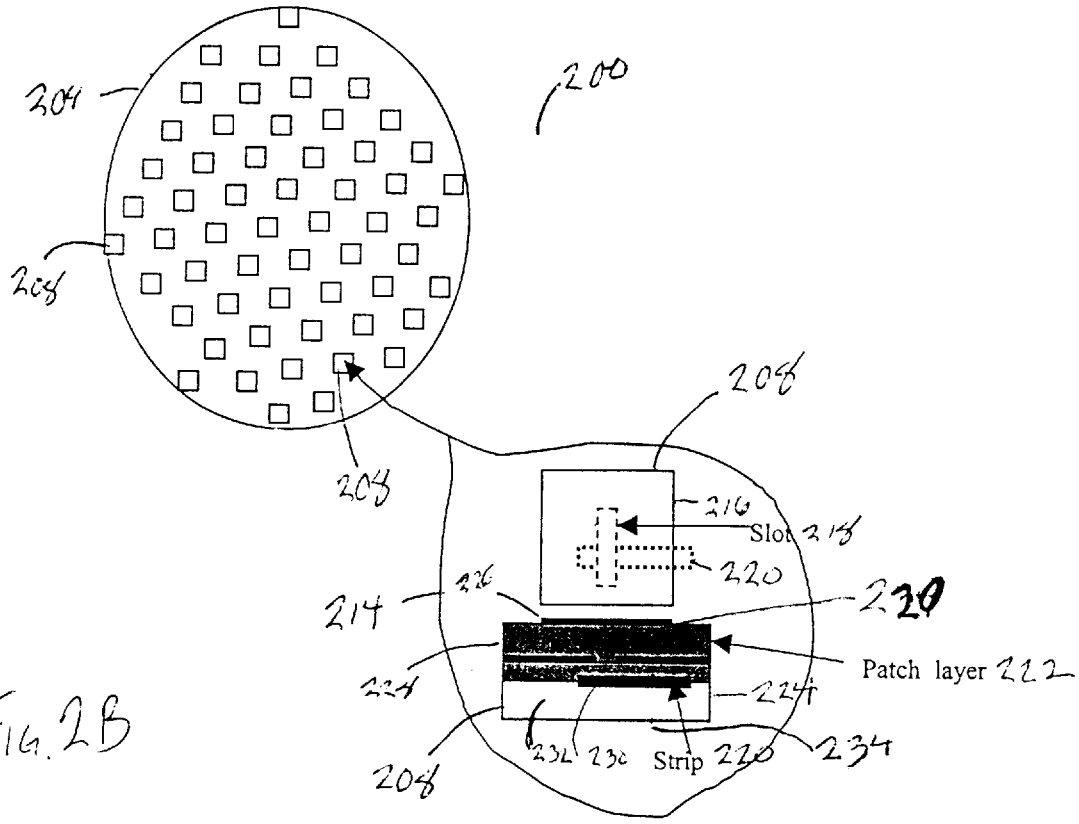

FIGS. 2A and 2B illustrate the reflect array element of the present invention. As shown in the side view of FIG. 2A, system 200 illustrates feed horn 202 directed at reflector 204 to create beam pattern 206. Feed horn 202 is similar or identical to feed horns 114–120 as described with respect to FIGS. 1A and 1B. Reflector 204 is similar or identical to reflectors 102–108 as described with respect to FIGS. 1A and 1B. Mounted to the front surface of reflector 204 are patch elements and/or dipole elements 208 such that when incident beam 210, emanating from feed horn 202, creates outgoing beam 212 and resulting beam pattern 206. Each element 208 is typically a two-layered slot coupled printed structure.

As shown in the front view of FIG. 2B, reflector 204 contains multiple reflect array elements 208 in either a random or ordered pattern on the front surface of reflector 204. Inset 214 illustrates a top view 216 of element 208, which shows slot 218 and strip 220 underlying element 208. Patch layer 222 is illustrated in side view 224 of inset 214.

The upper layer 226 is a patch 222 printed on a dielectric substrate 228. The bottom layer 230 comprises a narrow strip 220 printed on a thin dielectric layer 232. The strip 220 and the upper layer 226 patch 222 are mutually coupled via a ground plane slot 220. Another ground plane 234 exists behind the strip layer 220.

Phase Versus Length and Phase Dynamic Range

Reflect-array antennas can be used for shaped beam or pencil beams. The advantage of a reflect array antenna over a parabolic or shaped reflector lies on its flat structure that has low manufacturing cost and has packaging advantages for satellite applications. The conventional elements used in a typical reflect array antenna are printed dipoles or printed patches. Reflect arrays with conventional elements have either narrow bandwidth or low gain. The gain and bandwidth of a reflect array system are dependent upon the electrical characteristics of the elements.

Figure 3:
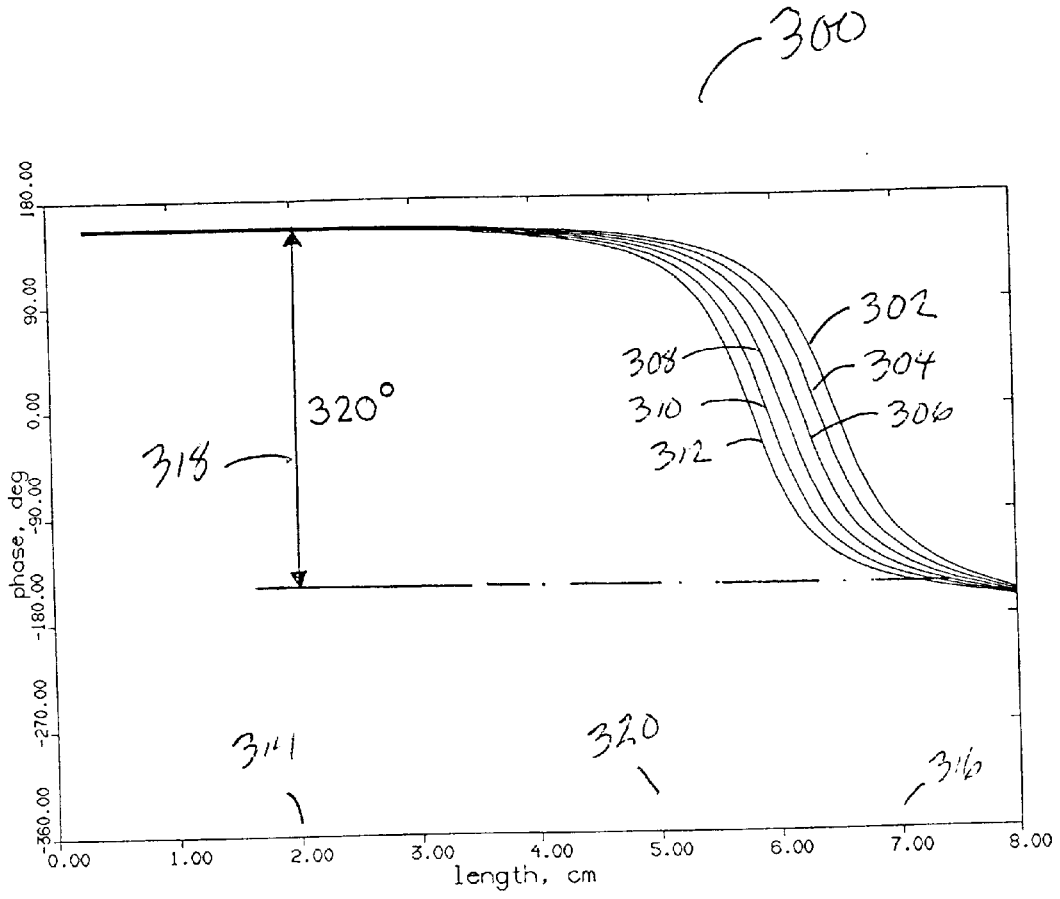
FIGS. 3 and 4 illustrate phase versus length curves for typical patch elements of the related art.
Figure 4:
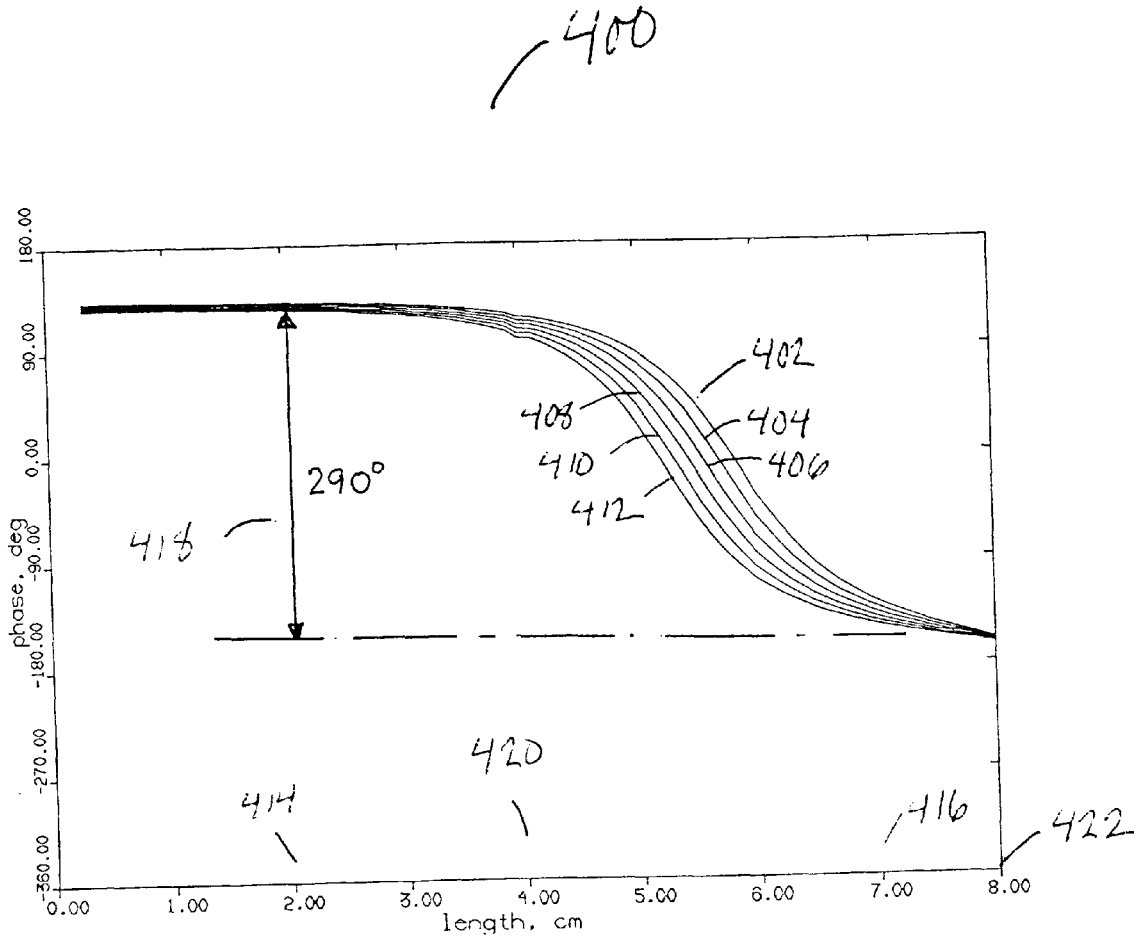

FIGS. 3 and 4 illustrate phase versus length curves for typical patch elements of the related art.

Graph 300 illustrates the phase versus length curves for a 0.5cm thick substrate patch element of the related art. The patch element is square, and curves 302–312 are shown. Curve 302 represents the frequency response of the patch at a 1.9 GHz frequency. Curve 304 represents the frequency response of the patch at a 1.95 GHz frequency. Curve 306 represents the frequency response of the patch at a 2.0 GHz frequency. Curve 308 represents the frequency response of the patch at a 2.05 GHz frequency. Curve 310 represents the frequency response of the patch at a 2.1 GHz frequency. Curve 312 represents the frequency response of the patch at a 2.15 GHz frequency. For patch lengths varying from 2 cm at point 314 to 7 cm at point 316, the phase response 318 is approximately 320 degrees. The majority of the phase response is for patch lengths between 5 cm at point 320 and 7 cm at point 316.

Graph 400 shown in FIG. 4 illustrates the phase versus length curves for a 1.0 cm thick substrate patch element of the related art. The patch element is square, and curves 402–412 are shown. Curve 402 represents the frequency response of the patch at a 1.9 GHz frequency. Curve 404 represents the frequency response of the patch at a 1.95 GHz frequency. Curve 406 represents the frequency response of the patch at a 2.0 GHz frequency. Curve 408 represents the frequency response of the patch at a 2.05 GHz frequency. Curve 410 represents the frequency response of the patch at a 2.1 GHz frequency. Curve 412 represents the frequency response of the patch at a 2.15 GHz frequency. For patch lengths varying from 2 cm at point 414 to 7 cm at point 416, the phase response 418 is reduced from that of FIG. 3 to approximately 290 degrees. However, the majority of the phase response is increased to patch lengths between 4 cm at point 420 and 8 cm at point 422.

Figure 5:
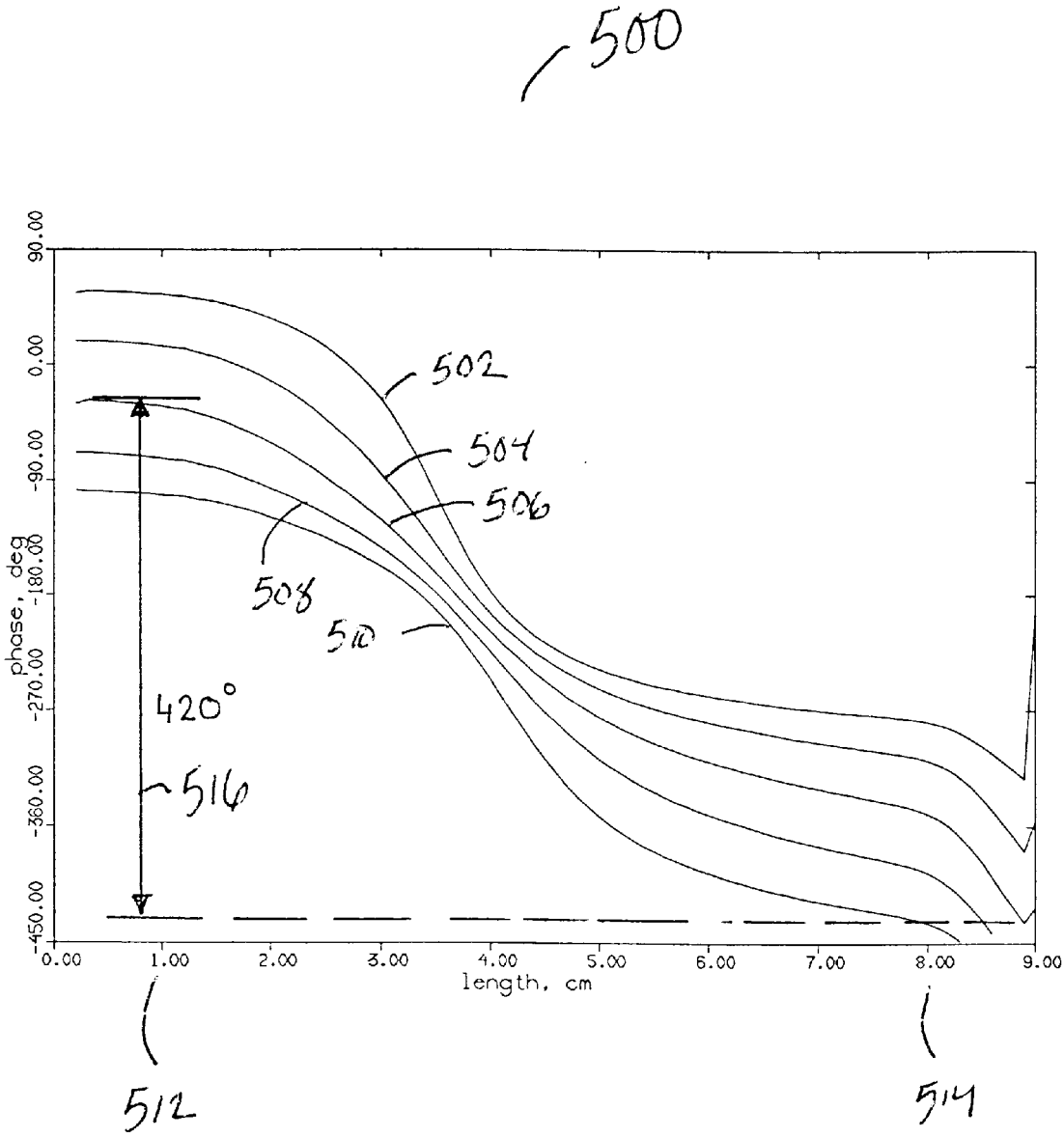
FIG. 5 illustrates the phase versus length curves for a 0.5cm thick substrate patch element of the present invention.

FIG. 5 illustrates the phase versus length curves for a 0.5 cm thick substrate patch element of the present invention. The patch element is square, but now comprises a slot coupling into the patch element 208 as described with respect to FIGS. 2A and 2B. The patch dimensions are 5.8 cm by 5.8 cm, with a strip substrate thickness of 0.318 cm. Curves 502–510 are shown. Curve 502 represents the frequency response of the patch element 208 of the present invention at a 1.9 GHz frequency. Curve 504 represents the frequency response of the patch element 208 of the present invention at a 1.95 GHz frequency. Curve 506 represents the frequency response of the patch element 208 of the present invention at a 2.0 GHz frequency. Curve 508 represents the frequency response of the patch element 208 of the present invention at a 2.05 GHz frequency. Curve 510 represents the frequency response of the patch element 208 of the present invention at a 2.1 GHz frequency. The patch element 208 of the present invention now has a larger patch length range as compared to the patches of the related art shown in FIGS. 3 and 4; for patch lengths vary from 1 cm at point 512 to 8 cm at point 514, which represents an increased range over the related art, the phase response 516 is also increased from that of FIG. 3 to approximately 420 degrees. The majority of the phase response is also increased to strip lengths between 1 cm at point 512 and 8 cm at point 514.

Patch elements should provide a 360 degree phase response to be able to reflect every possible signal. As such, the patch element 208 of the present invention, which comprises a slot coupled patch element 208, provides superior wide band performance over the patch elements of the related art. Since the dynamic range of the phase (ideally one needs at least 360 degree dynamic range) is reduced in the related art patch elements, some of the element phases that are beyond the available dynamic range cannot be realized by varying the physical dimensions of the patch elements of the related art, which causes a reduction in the gain of the array. The patch elements 208 of the present invention suffer no such infirmity, because they have a dynamic range of greater than 360 degrees, and therefore, a reflect array system using the present invention will show higher gain over a wider frequency band than a system that uses patch elements of the related art.

Referring to FIGS. 2A and 2B, which show the configuration of an offset-fed reflect array antenna system, the primary feed horn 202 is typically a horn radiator with 10 dB taper radiation patterns from the center to the edge of the reflector 204 surface. The RF energy 210 emanating from the feed horn 202 is incident upon the reflect array elements 208 and is reradiated as RF energy 212 in the desired direction. The desired phase distribution for the reflect array elements 208 is realized by varying the dimensions of the elements 208.

For the conventional reflect array elements, e.g., patch or dipole elements, the dynamic range of the realizable phase is lower than 360 degrees as described with respect to FIGS. 3 and 4. This low dynamic range condition has significant effects on the gain performance of the reflect array system 200. The dynamic range can be somewhat increased by reducing the substrate thickness as discussed with respect to FIG. 4. In that situation the gain of the reflect array at a given frequency, e.g., the frequency for which the phase distribution is realized can be improved, but the gain rapidly deteriorates as the frequency changes. Therefore, the bandwidth performance for the system 200 becomes poor.

A reflect array antenna system 200 using the patch elements 208 of the present invention exhibits an improved gain over a wide frequency band as compared to the related art, as shown in FIG. 5. These desired improvements are due to the electrical characteristics of the element. The S-curve for this element is fairly linear, and each element 208 of the present invention has more than 360 degrees 'phase-dynamic-range.' This desirable behavior can be explained from the physical structure of the element of the present invention. The slot-coupled patch element 208 structure as described in FIG. 2B is designed in such a way that the patch is electrically matched with the strip 20 line section his happens if the input impedance of the aperture (slot 218) coupled patch and the characteristic impedance of the strip 220 line are of the same order. If this 'matching' condition is satisfied, then the RF power incident upon the patch surface 226 is completely coupled to the strip 220 section. Since the strip has open ends, the RF energy reflects back from the edges and couples back to the patch through the coupling slot 218 and re-radiates to the free space. The phase difference between the incident and reradiated RF power varies linearly for a perfectly matched condition with the strip 220 line length. Unlike a reflect array with conventional patch elements, the patch dimensions of the present invention do not change from element 208 to element 208. Rather, the phase distribution is realized by varying the strip 220 lengths. Since the strips 220 have smaller widths, a longer strip 220, which may be longer than the cell dimensions, can be realized in a unit cell using one on more smooth bends. Furthermore, the strips 220 are etched on a dielectric 232 with a larger dielectric constant than the patch substrate 228, therefore the strip 220 lengths can be varied to achieve a larger phase-dynamic-range, e.g., significantly beyond 360 degrees. This phase-linearity property is fairly maintained over a frequency band that is equal to the frequency bandwidth of a slot-fed patch in an array environment.

Computer Simulated Results

In order to verify the validity of the above concept, a reflect array element was designed and the S-curves were generated as shown in FIG. 5. A center-fed reflect array for a pencil beam pattern 206 was designed and the gain-bandwidth performances were evaluated for different elements 208. The number of elements 208 in the reflect array was four hundred and one (401), arranged in a square grid over a circular aperture of diameter about 180 cm. The feed horn 202 was placed at a distance 200 cm from the center of the reflector 204. The cell dimensions were 8 cm×8 cm.

Figure 6:
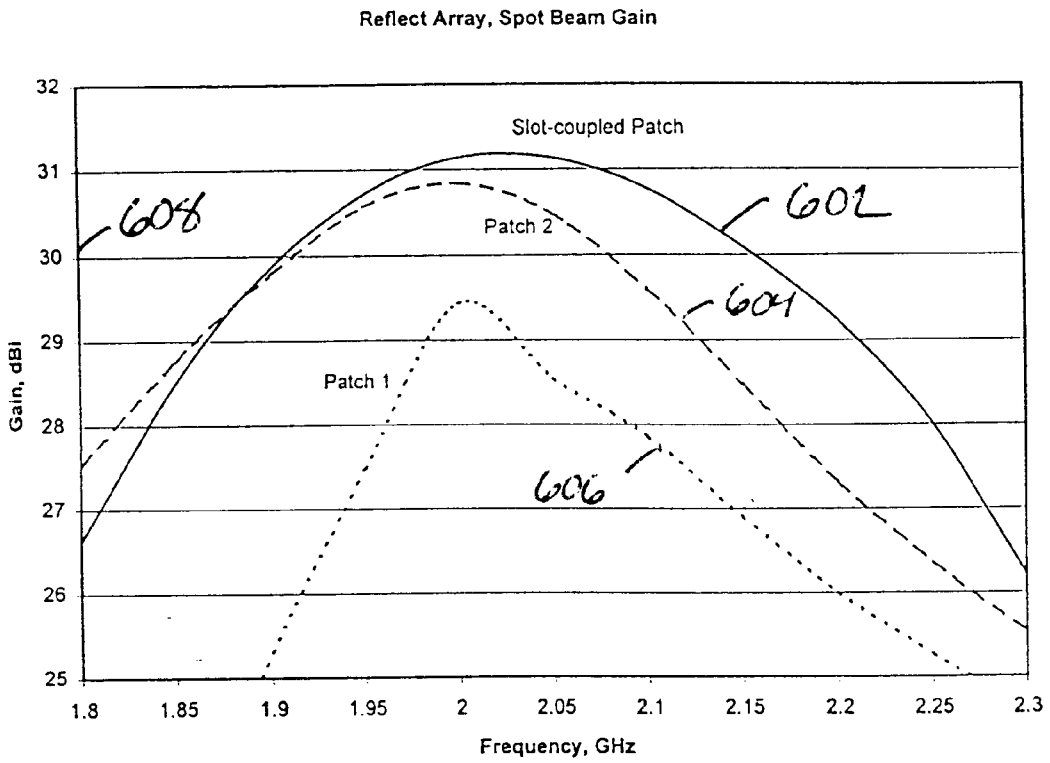
FIGS. 6 and 7 illustrate the gain-bandwidth performances of a reflect array using the elements of the present invention as compared to patch elements of the related art.
Figure 7:
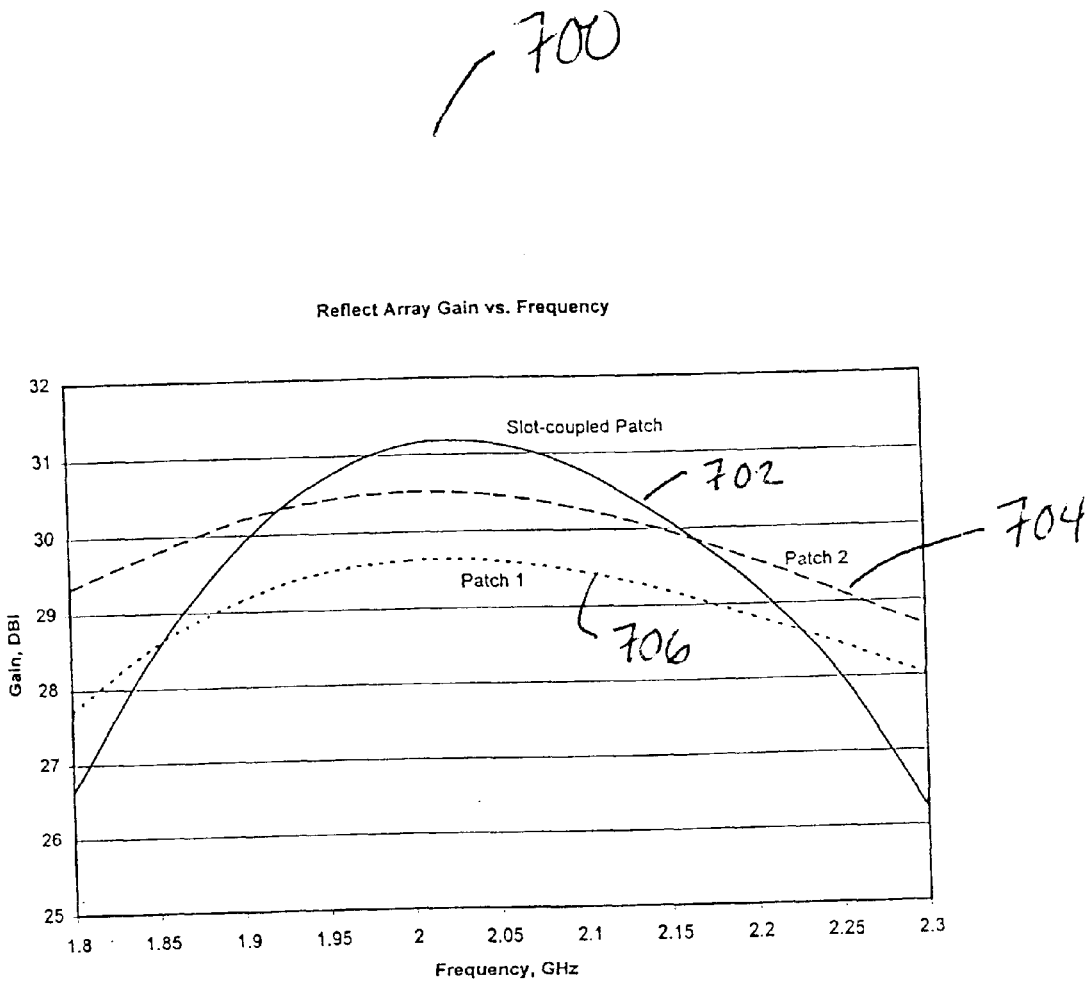

FIGS. 6 and 7 illustrate the gain-bandwidth performances of a reflect array using the elements of the present invention as compared to patch elements of the related art.

FIG. 6 illustrates graph 600, which compares the gain-bandwidth performance of the present invention in curve 602, to the gain-bandwidth performance of a patch with maximum dimensions of 7.2 cm by 7.2 cm in curve 604, and to the gain-bandwidth performance of a patch with maximum dimensions 6.4 cm by 6.4 cm in curve 606. Each patch element was printed on a low dielectric substrate of dielectric constant of 1.1 and a substrate thickness of 0.5 cm. For the element 208 of the present invention shown in curve 602, the strip substrate thickness was 0.318 cm, and the dimensions of the patch element was 5.8 cm×5.8 cm The strips 220 were varied in length to realize the desired phase distribution at a 2 GHz frequency. The fabrication of the patch elements shown by curves 604 and 606 require that the maximum dimensions of the patch elements must be less than the cell dimensions. Two different upper limits of the patch dimensions were set for the results. Curve 604 corresponds to the patch elements in the reflect array where the maximum patch dimensions were set to 90% of the cell dimensions. Curve 606 corresponds to the patch elements reflect array where the maximum patch dimensions were set to 80% of the cell dimensions.

Curve 606 shows lower gain than that of curve 604, because of the smaller phase-dynamic-range corresponding to a smaller range of the physical dimensions of the patch elements. However, the reflect array using the elements 208 of the present invention has improved gain-bandwidth performance as compared to both other systems using patch elements of the related art. The 30-dBi gain 608 bandwidth is obtained as 12.5 % for the reflect array using the present invention. The 30-dBi gain 608 bandwidth for the conventional patch elements was only 8.2% for curve 604, and curve 606 did not reach to the 30-dBi gain 608 value.

FIG. 7 illustrates graph 700, which compares the gain-bandwidth performance of the present invention in curve 702, to the gain-bandwidth performance of a patch with maximum dimensions of 7.2 cm by 7.2 cm in curve 704, and to the gain-bandwidth performance of a patch with maximum dimensions 6.4 cm by 6.4 cm in curve 706. Each patch element was printed on a low dielectric substrate of dielectric constant of 1.1 and a substrate thickness of 1.0 cm, as compared to the 0.5 cm thickness described in FIG. 6. For the element 208 of the present invention shown in curve 702, the strip substrate thickness was 0.318 cm, and the dimensions of the patch element was 5.8 cm×5.8 cm.

The strips 220 were varied in length to realize the desired phase distribution at a 2 GHz frequency. The fabrication of the patch elements shown by curves 704 and 706 require that the maximum dimensions of the patch elements must be less than the cell dimensions. Two different upper limits of the patch dimensions were set for the results. Carve 704 corresponds to the patch elements in the reflect array where the maximum patch dimensions were set to 90% of the cell dimensions. Curve 706 corresponds to the patch elements reflect array where the maximum patch dimensions were set to 80% of the cell dimensions.

Curve 706 shows lower gain than that of curve 704, because of the smaller phase-dynamic-range corresponding to a smaller range of the physical dimensions of the patch elements. However, the reflect array using the elements 208 of the present invention has improved gain-bandwidth performance as compared to both other systems using patch elements of the related art. Although the bandwidth for curve 702 improves compared to that described with respect to FIG. 6, the peak gain is still 0.6 dB lower than the peak gain of the elements 208 of the present invention.

Dual-Linear and Dual-Circular Polarization Patch Elements

Figure 8A:
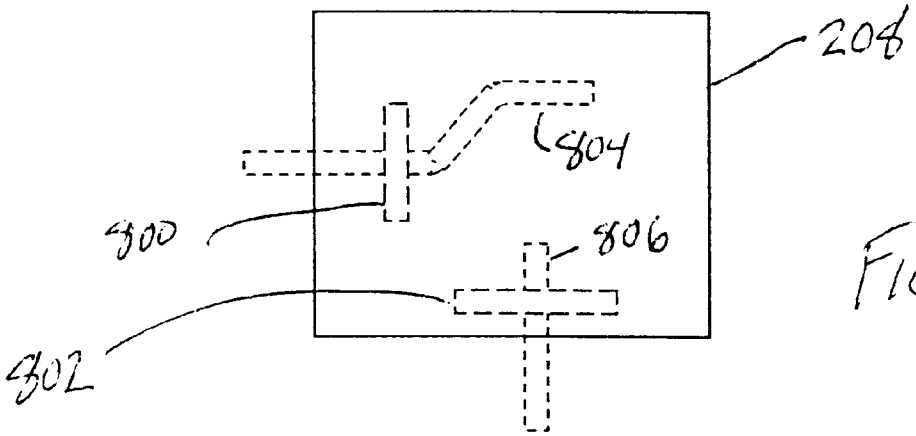
FIGS. 8A and 8B illustrate dual slot fed patch elements of the present invention.
Figure 8B:
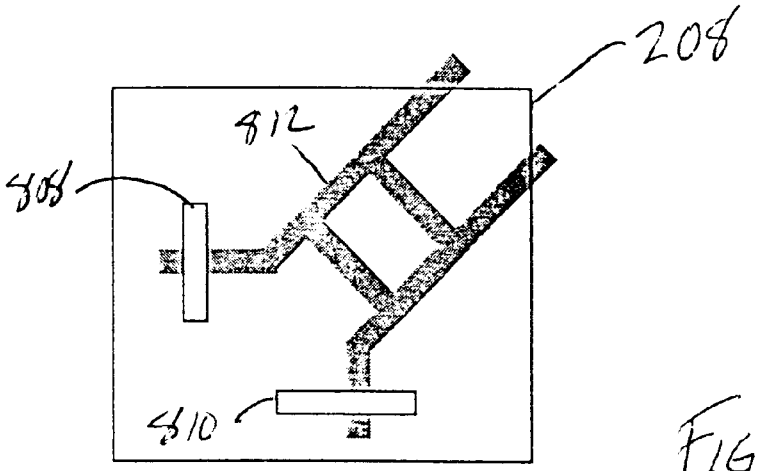

FIGS. 8A and 8B illustrate dual slot fed patch elements of the present invention. Although the results described in FIGS. 6 and 7 discuss pencil beam patch elements 208, similar results can be obtained for offset reflect array elements 208, dual linear polarization elements 208, and dual circular polarization elements 208. FIG. 8A illustrates a dual slot fed patch element 208, where slots 800 and 802 interact with strips 804 and 806. Since slots 800 and 802 are substantially perpendicular, each slot 800 and 802 will reradiate only one type of polarized RF radiation, and, as such, element 208 can be used as a dual linear polarized reflect array element.

FIG. 8B illustrates a circular polarization element 208. Slots 808 and 810 interact with strip 812, which is typically a printed strip 812. For circular polarization, the desired phase distribution for a pencil beam or a shaped beam can be realized either by varying the strip 812 lengths or by physically rotating the elements 208. In the later case, all the elements 208 will be physically identical. For a circular polarization application, a reflect using the elements 208 of the present invention will have a significantly wider bandwidth than that of a reflect array using conventional patch elements of the related art, because a conventional circularly polarized patch radiator, where the design is based on mode degeneracy, has an inherently narrow bandwidth as compared to that of a hybrid-fed circularly polarized patch.

Process Chart

Figure 9:
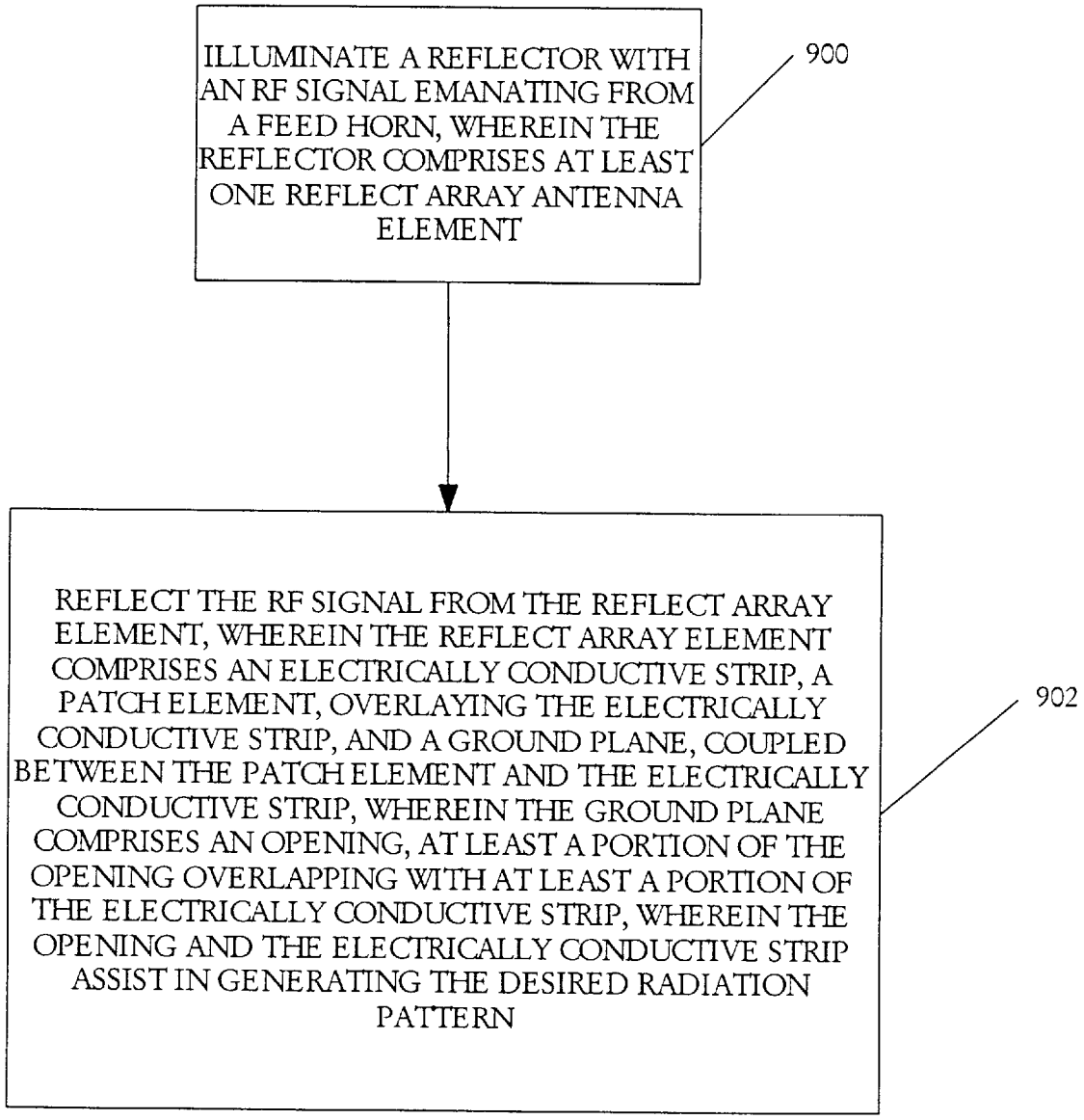
FIG. 9 is a flow chart illustrating the steps used to practice the present invention.

FIG. 9 is a flow chart illustrating the steps used to practice the present invention.

Block 900 illustrates performing the step of illuminating a reflector with an RF signal emanating from a feed horn, wherein the reflector comprises at least one reflect array antenna element.

Block 902 illustrates performing the step of reflecting the RF signal from the reflect array element, wherein the reflect array element comprises an electrically conductive strip, a patch element, overlaying the electrically conductive strip, and a ground plane, coupled between the patch element and the electrically conductive strip, severing the ground plane comprises an opening, at least a portion of the opening overlapping with at least a portion of the electrically conductive strip, wherein the opening and the electrically conductive strip assist in generating the desired radiation pattern.

Conclusion

In summary, the present invention discloses an antenna element, an antenna system, and a method for producing a signal using slot-coupled antenna elements. The antenna element comprises an electrically conductive strip, a patch element, overlaying the electrically conductive strip, and a ground plane. The ground plane is coupled between the patch element and the electrically conductive strip and comprises an opening, at least a portion of the opening overlapping with at least a portion of the electrically conductive strip, wherein the opening and the electrically conductive strip can reflect incident radio frequency (RF) energy in a desired radiation pattern.

A method in accordance with the present invention comprises illuminating a reflector with an RF signal emanating from a feed horn, wherein the reflector comprises at least one reflect array antenna element, and reflecting the RF signal from the reflect array element, wherein the reflect array element comprises an electrically conductive strip, a patch element, overlaying the electrically conductive strip, and a ground plane. The ground plane is coupled between the patch element and the electrically conductive strip and comprises an opening, at least a portion of the opening overlapping with at least a portion of the electrically conductive strip, wherein the opening and the electrically conductive strip.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A slot-coupled reflect array antenna element, comprising:

an electrically conductive strip;

a patch element, overlaying the electrically conductive strip; and a ground plane, coupled between the patch element and the electrically conductive strip, wherein the ground plane comprises an opening, at least a portion of the opening overlapping with at least a portion of the electrically conductive strip, wherein the opening and the electrically conductive strip can reflect incident radio frequency RF energy in a desired radiation pattern.

2. The slot-coupled reflect array antenna element of claim 1, wherein the electrically conductive strip is printed on a dielectric layer.

3. The slot-coupled reflect array antenna element of claim 1, wherein the patch is printed on a dielectric layer.

4. The slot-coupled reflect array antenna element of claim 1, further comprising a second ground plane underneath the electrically conductive strip.

5. The slot-coupled reflect array antenna element of claim 1, wherein a length of the electrically coupled strip is varied to adjust the phase response of the slot-coupled reflect array antenna element.

6. The slot-coupled reflect array antenna element of claim 1, further comprising a second opening in the ground plane and a second electrically coupled strip, wherein at least a portion of the second opening overlaps with at least a portion of the second electrically conductive strip, wherein the second opening and the second electrically conductive strip can reflect incident radio frequency (RF) energy in a desired radiation pattern.

7. The slot-coupled reflect array antenna element of claim 6, wherein the incident RF energy comprises a first polarization of incident RF energy and a second polarization of incident RF energy, and the opening and electrically conductive strip reflect substantially only the first polarization of incident RF energy and the second opening and second electrically conductive strip reflect substantially only the second polarization of incident RF energy.

8. The slot-coupled reflect array antenna element of claim 7, wherein the first polarization is horizontal polarization and the second polarization is vertical polarization.

9. The slot-coupled reflect array antenna element of claim 7, wherein the first polarization is left-hand circular polarization and the second polarization is right-hand circular polarization.

10. A method for generating a desired radiation pattern, comprising:

illuminating a reflector with an RF signal emanating from a feed horn, wherein the reflector comprises at least one reflect array antenna element; and reflecting the RF signal from the reflect array element, wherein the reflect array element comprises:

an electrically conductive strip;

a patch element, overlaying the electrically conductive strip; and a ground plane, coupled between the patch element and the electrically conductive strip, wherein the ground plane comprises an opening, at least a portion of the opening overlapping with at least a portion of the electrically conductive strip, wherein the opening and the electrically conductive strip assist in generating the desired radiation pattern.

11. The method of claim 10, wherein the reflector is substantially flat in shape.

12. The method of claim 10, wherein the feed horn illuminates the reflector with signals of more than one polarization.

13. A reflect array antenna system, comprising:

a feed horn, wherein the feed horn provides a radio frequency (RF) signal;

a reflector, aligned with the feed horn, the reflector being illuminated by the feed horn; and at least one reflect array element, wherein the reflect array element comprises:

an electrically conductive strip;

a patch element, overlaying the electrically conductive strip; and a ground plane, coupled between the patch element and the electrically conductive strip, wherein the ground plane comprises an opening, at least a portion of the opening overlapping with at least a portion of the electrically conductive strip, wherein the opening and the electrically conductive strip.

* * * * *